US006109836A

United States Patent [19]

Gritti

[11] Patent Number: 6,109,836

[45] Date of Patent: Aug. 29, 2000

[54] SOIL CONSOLIDATION APPARATUS, TOOL AND METHOD

[75] Inventor: Gianpietro Gritti, Bresciano, Italy

[73] Assignee: Sandvik AB, Sandviken, Sweden

[21] Appl. No.: 09/196,116

[22] Filed: Nov. 20, 1998

[30] Foreign Application Priority Data

Nov. 21, 1997 [SE] Sweden ..... 9704292

[51] Int. Cl.[7] ..... E02B 3/12; E21B 4/14; E21B 10/38

[52] U.S. Cl. ..... 405/266; 405/269; 175/296

[58] Field of Search ..... 405/237, 240, 405/241, 248, 258, 266–268, 269, 303; 175/293, 296, 298

[56] References Cited

U.S. PATENT DOCUMENTS

| | | | |
|---|---|---|---|
| 3,188,817 | 6/1965 | Myers | 405/241 |
| 3,200,599 | 8/1965 | Phares et al. | 405/241 |
| 3,255,592 | 6/1966 | Moor | 405/238 |
| 3,800,544 | 4/1974 | Nakanishi | 405/266 |
| 3,949,561 | 4/1976 | Chapman | 405/266 |
| 4,832,535 | 5/1989 | Crambes | 405/266 |
| 5,107,944 | 4/1992 | Gustafsson | 175/296 |
| 5,219,247 | 6/1993 | Gemmi et al. | 405/241 |
| 5,256,004 | 10/1993 | Gemmi et al. | 405/237 |
| 5,497,839 | 3/1996 | Moir | 175/296 X |
| 5,645,132 | 7/1997 | Åsberg | 175/318 |
| 5,803,188 | 9/1998 | McInnes | 175/296 X |
| 5,904,447 | 5/1999 | Sutton et al. | 405/266 X |
| 5,957,220 | 9/1999 | Coffman et al. | 175/296 X |

FOREIGN PATENT DOCUMENTS

| | | |
|---|---|---|
| 42 35 378 | 4/1994 | Germany . |
| 196 37 991 | 4/1997 | Germany . |

*Primary Examiner*—Eileen Dunn Lillis
*Assistant Examiner*—Tara L. Mayo
*Attorney, Agent, or Firm*—Burns, Doane, Swecker & Mathis, L.L.P.

[57] ABSTRACT

In order to consolidate soil, a hole is drilled therein by advancing downwardly through the soil a rotary percussive drill bit disposed at the end of a drill string. Water is pressurized at the ground surface and is conducted to actuate a hydraulically driven down-the-hole hammer disposed above the drill bit. While vertically retracting and rotating the drill string, grout, which is pressurized at the ground surface, is conducted downwardly through the drill string and ejected laterally outwardly through a lateral opening in the drill string to produce a console of mixed soil and grout surrounding the hole. The water and grout are pressurized in respective chambers of a pump.

15 Claims, 3 Drawing Sheets

SOIL CONSOLIDATION APPARATUS, TOOL AND METHOD

FIELD OF THE INVENTION

The present invention relates to a soil consolidation apparatus, as well as a tool and a method for soil consolidation.

BACKGROUND OF THE INVENTION

The technique of soil consolidation has been used for the static retrofit of existing structures for several years. Soil consolidation is ideally suited for solving foundation problems in areas of tight access, low overhead or difficult geology conditions. A typical method of soil consolidation is to drill a bore by rotating a rotary drill bit by means of a tube string, opening a free end of the string and inserting a ball that gravitates onto a seat in the drill string located adjacent to the drill bit. Thus a check valve is created shutting the channel to the rotary drill bit and allowing jet grouting of the soil adjacent to the hole during retraction of the string and the drill bit. When the soil to be consolidated includes big boulders (e.g., having diameters of 0.3 to 1.0 m) the known method becomes ineffective in terms of penetration speed.

When that kind of boulder-containing soil is to be consolidated it is often necessary to use a top hammer equipment wherein the hammer impacts on a sealed drill string which transfers the resulting shock waves to a percussive drill bit. When the drill bit has reached its predetermined position down into the soil, jet grouting is commenced at 300 to 500 bars of internal pressure. However, the shock waves will eventually impair the function of the seals mounted in every drill string joint, whereupon the grout will leak and abrade holes in the expensive drill tubes. Also, the leakage will result in the jet grouting being performed at a lower pressure than intended. As soon as the leakage is discovered the drill tube is exchanged.

Disclosed in U.S. Pat. No. 5,219,247 is a soil consolidation apparatus utilizing an air-driven down-the-hole hammer. However, that apparatus requires the use of at least two pressurizing means, i.e., one compressor to pressurize air and one pump for jet grouting. Furthermore, the air has to be pressurized to a high level by the compressor for lifting the cuttings, and thus the soil surrounding the hole will be eroded by the high-pressure air.

OBJECTS AND SUMMARY OF THE INVENTION

One object of the present invention is to provide an improved soil consolidation apparatus, and a tool and method for soil consolidation that retain the advantages of the prior art.

Another object of the present invention is to provide a soil consolidation apparatus which is environment friendly.

Still another object of the present invention is to provide a soil consolidation apparatus which needs only one pressurizing means to function.

Still another object of the present invention is to provide a soil consolidation apparatus which can penetrate the soil at a high production rate without impairing the drill tubes.

These and other objects are attained by a method of consolidating soil comprising the steps of:

A) drilling a hole by advancing downwardly through the soil a rotary percussive drill bit disposed at the end of a drill string;

B) pressurizing hydraulic fluid at the ground surface and conducting the pressurized hydraulic fluid downwardly through the drill string during step A to actuate a down-the-hole hammer disposed above the drill bit for applying percussive impacts thereto;

C) retracting the drill string upwardly while rotating the drill string; and

D) pressurizing grout at the ground surface and conducting the pressurized grout downwardly through the drill string during step C and ejecting the pressurized grout laterally outwardly through a lateral opening in the drill string whereby the opening rotates with the drill string to produce a console of mixed soil and grout surrounding the hole.

The present invention also relates to a soil consolidation apparatus which comprises a drill rig and a drill string mounted to the drill rig to be rotated, lowered and raised thereby. A percussive drill bit is mounted at an end of the drill string. A down-the-hole hammer is mounted above the drill bit for applying percussive impacts thereto. A source of hydraulic fluid, and a source of grout are provided. Pressurizing apparatus is provided for selectively pressurizing the hydraulic fluid and the grout. The drill string includes a lateral opening formed therein. A first channel is disposed in the drill string and is connected to the hammer for conducting pressurized hydraulic fluid to the hammer for actuating the hammer during a drilling operation. A second channel is disposed in the drill string separate from the first channel, for conducting pressurized grout to the lateral opening for ejection therethrough during upward retraction of the drill string.

The invention further relates to a soil consolidation tool which comprises a drill string and a percussive drill bit mounted at an end of the drill string. A hydraulically driven down-the-hole hammer is mounted above the drill bit. A first channel is disposed in the drill string and is connected to the hammer for conducting pressurized hydraulic fluid thereto. A lateral grout-ejecting opening is disposed in the drill string. A second channel is formed in the drill string separate from the first channel and connected to the grout-ejecting opening for conducting pressurized grout to the opening.

BRIEF DESCRIPTION OF THE DRAWINGS

The objects and advantages of the invention will become apparent from the following detailed description of a preferred embodiment thereof in connection with the accompanying drawings, in which like numerals designate like elements, and in which.

DETAILED DESCRIPTION OF A PREFERRED EMBODIMENT OF THE PRESENT INVENTION

Figure 1:
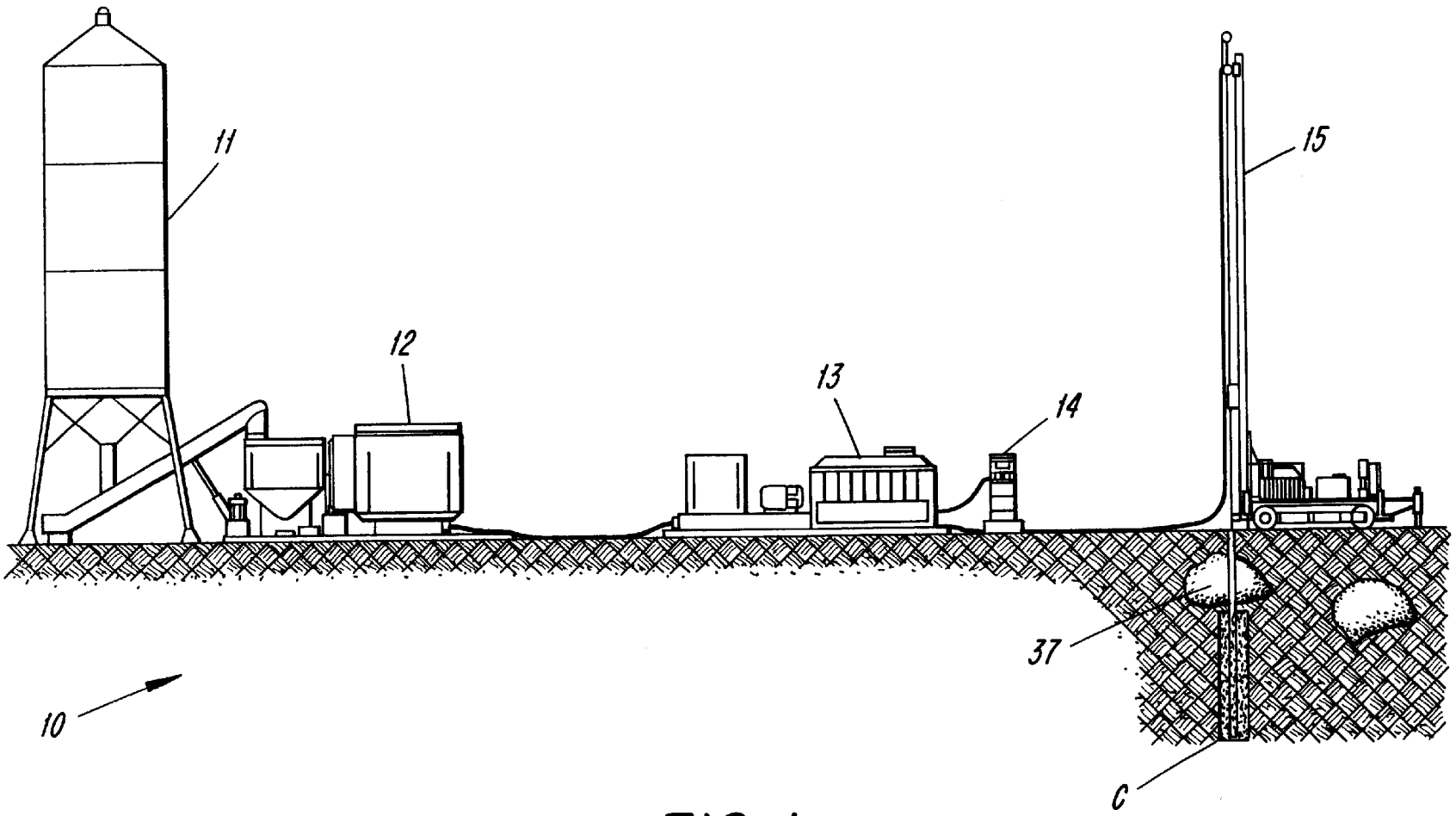
FIG. 1 shows a drilling site having a soil consolidation apparatus according to the present invention.

In FIG. 1 is generally shown a set-up of equipment 10 needed for soil consolidation according to the present invention. The equipment comprises a silo 11 for cement, a mixer 12 for mixing water and cement into a grout, a pressuring device in the form of a pump 13 having at least two chambers for respectively pumping hydraulic fluid (preferably water) and the grout, a control panel 14 for controlling the parameters of the equipment 10, and a drill rig 15. That equipment is conventional and readily available on the market. The setup shown in FIG. 1 is different from a conventional soil consolidation set-up in that a two-chamber pump 13 is used in place of a pump and separate air compressor, and no air is compressed.

The present invention is further different from a prior art soil consolidation set-up in that the drill rig 15 carries a hydraulically (liquid) driven down-the-hole hammer 16 instead of an air (pneumatically) driven down-the hole hammer. Now referring to FIG. 2, the hydraulic down-the-hole hammer 16 is shown which is adapted to be raised and lowered by the rig 15. The hammer 16 is connected to a one-way (non-return) valve 39, which in turn is connected to a jet grouting monitor 18, which in turn is connected to a drill string 17. The drill string 17 comprises a number of double-lead, high pressure drill tube sections 17A duly sealed in the thread areas. The hammer 16 is a conventional hydraulic (preferably water-driven) hammer preferably of the type disclosed in U.S. Pat. No. 5,107,944 the disclosure of which is incorporated herein by reference. The water driven hammer carries a percussive drill bit 19 preferably of the type disclosed in U.S. Pat. No. 5,645,132, the disclosure of which is also incorporated herein by reference.

As is conventional, the rearward end of the hammer 16 is provided with a drive piston 20 reciprocable in a cylinder. The front end of the piston is guided for reciprocation in a bearing located adjacent an anvil of the drill bit. Between the cylinder and the bearing, the hammer is elongated and enlarged diametrically relative to the piston. A port is provided in the rear end for supplying pressurized hydraulic fluid from the drill tube. The enlarged hammer portion reciprocates freely in a chamber formed by an outer casing 21. The casing is mounted to the front end of the drill rod. The drill bit is slidably received and retained by the front end of the casing having a channel extending longitudinally therethrough. Drive water is expelled from the cylinder and flushes the hole drilled by the bit 19. An open ended tubular valve reciprocates to control a duct connecting the interior of the valve to a coaxial through-flushing passage 23 formed in the hammer and the drill bit.

The percussion drill bit 19 includes a drill body having the fluid passage 23 for conducting flushing fluid to a front drilling face of the drill bit. The fluid passage includes a main portion extending from a rear end of the bit and terminating short of the drilling face, and a plurality of branch lines extending from a front end of the main portion to the drilling face. Front and rear axially spaced seats are disposed in the main portion of the fluid passage. A check valve in the form of a ball 24 is freely movable within the main portion of the fluid passage between contact with the front and rear seats. When the drill bit is subjected to external over-pressure or when it is oriented upwardly and no flushing water is supplied, the ball moves rearwardly into sealing contact with the rear seat so that no water or contamination can flow rearwardly past the rear seat. When flushing fluid is conducted, the flushing fluid pushes the ball forwardly, into non-sealing contact with the front seat and travels past the ball into the branch lines. During downwards drilling, if the density of the ball is less than that of backflowing water, the ball will float upwardly upon the backflowing water and into sealing contact with the rear seat.

The fluid passage can also be sealed against back flow at a location above the hammer by means of a check valve device 39 having a movable ball 39A which is movable upwardly against a seat 39B to block fluid flow.

Figure 2:
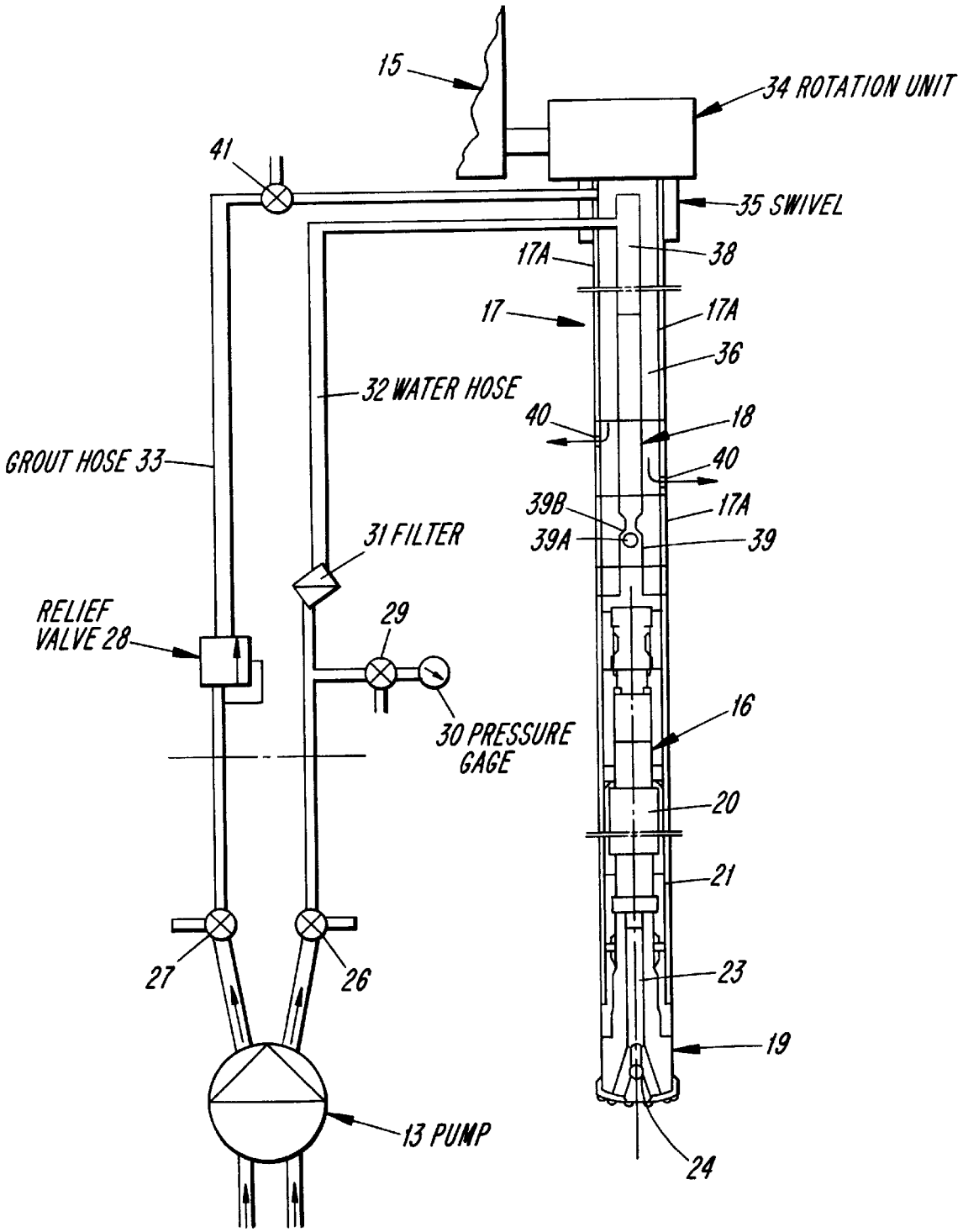
FIG. 2 schematically shows a pump flow circuit in connection with a tool according to the present invention.

In FIG. 2 is shown the tool in the consolidation apparatus and also shown are the pump 13, manual shut off valves 26,27,41, a maximum pressure relief valve 28, a manual relief valve 29, a pressure gage 30, a filter 31, high pressure hoses 32, 33 and a rotation unit 34.

The tool is mounted by threading the check valve device 39 onto the threaded upper end of the hammer 16. The jet grouting monitor 18 is threaded onto the check valve 39, and the drill tube is threaded onto the jet grouting monitor 18. An inner pipe or channel 38 is mounted substantially simultaneously with the drill tube.

Figure 3:
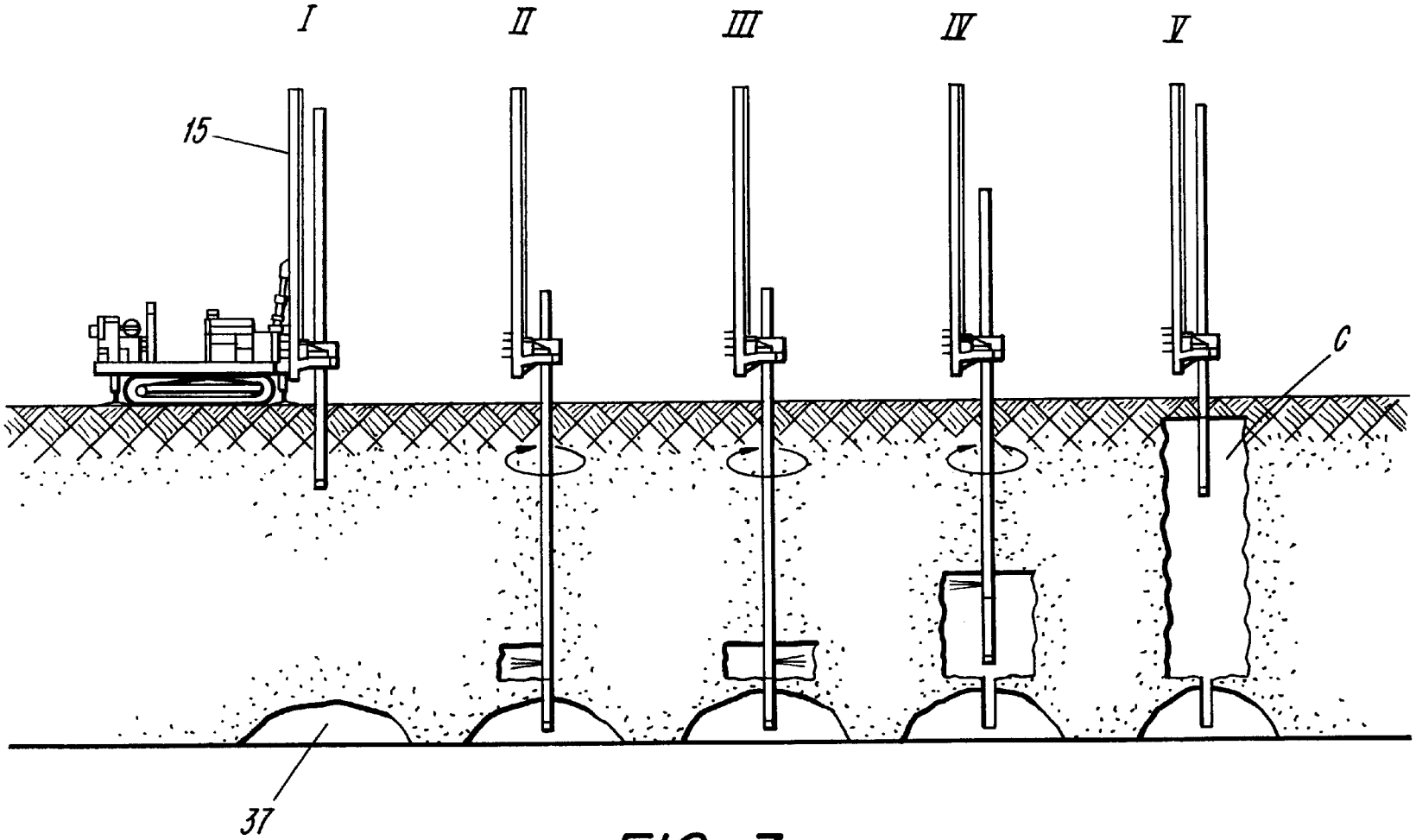
FIG. 3 shows the principal steps involved in operating the soil consolidation apparatus according to the present invention.

When the drill rig 15 has been positioned at the drilling site as shown at step I in FIG. 3, with the tool connected to the rotation unit 34 of the drill rig, the valve 26 is opened. Thus, high pressurized water from the pump 13, pressurized up to 80 to 200 bar, will run through the hose 32 and the filter 31, and successively through a swivel 35, the water channel 38 in the drill string 17, forcing open check valve 39 and entering the hammer 16. The piston 20 of the hammer will then impact on the rear end of the drill bit 19, thereby transferring shock waves to the bit buttons impacting on the soil or the rock. If boulders 37 are present in the feed direction of the drill string there will be no stoppage of the drilling operation since the down-the-hole hammer is adapted for hard rock drilling. Spent drive water is used to cool the drill bit and to remove drill cuttings in front of the drill bit upwardly outside the drill string and carry the cuttings to the surface. When additional tool length is required as drilling progresses, the water supply is cut off via the valve 26 and an additional inner pipe 38 and an external tube section 17A are mounted, usually every 2 m of drilling advancement. When the drill bit has reached its predetermined depth as shown at step II in FIG. 3 the manual shut off valve 26 is closed and the pressure in the hose 32 is relieved. When the water supply is thus cut off, any back-flow of fluid occurring in the bit 19 causes the ball 24 to ascend to the rear seat and seal the hammer from any back-flowing fluid. To minimize said back-flow through channel 23 the additional check valve 39 seals the water pipe 38 above the hammer to create a counter pressure if back-flow starts.

Then, the drill bit is withdrawn upwardly while the hole is grouted. The grout is introduced into the pump 13 and pressurized up to maximum 500 bar. Then the valve 27 is opened and the highly pressurized grout will run through the hose 33 and the pressure relief valve 28, and successively through the swivel 35, a grout channel 36 in the drill string 17 and out through openings or grout channel ejectors 40 of the jet grouting monitor 18. The grout will not enter the hammer 16 since the hammer and the water chamber 38 are sealed and separate from the grout channel 36. The rotation unit 34 is started, to rotate the drill string while retracting it. The lateral jet stream of grout exiting from the openings 40 will mix with the surrounding soil to a diameter of one meter maximum and produced a console C of mixed soil and grout extending about as high as the depth of the drilled hole as shown in steps II–V of FIG. 3. After completion of the consolidation process, the drill string is completely retracted from the drilled hole and often the jet line 33, 36, 40 is flushed with water before the valve 27 is closed. During retraction of the tool the grout supply is periodically cut off via the valve 41 such that the inner pipes 38 and external tube sections 1 7A can be dismounted. Then the consolidation apparatus is ready to drill a new hole by opening the valve 26 for a new drill cycle.

It should be noted that the present invention provides numerous additional advantages relative to prior art devices.

A water driven hammer will not affect the surrounding soil as much as air driven tools with respect to erosion, oil pollution and noise, For example, with respect to erosion, the speed of water to drive the water driven hammer is about 1 m/s as compared to an air driven hammer wherein the air speed is about 20 m/s. The apparatus according to the present invention obviates the need for an air compressor. Furthermore by using a water driven hammer the hammer will not be heated and thus the grout will not dry on the hammer to counteract extraction of the hammer.

The invention can be varied freely within the scope of the appended claims. Although the present invention has been described in connection with a preferred embodiment thereof, it will be appreciated by those skilled in the art that additions, deletions, modifications, and substitutions not specifically described may be made without departing from the spirit and scope of the invention as defined in the appended claims.

What is claimed is:

1. A method of consolidating soil comprising the steps of:

A) drilling a hole by advancing downwardly through the soil a rotary percussive drill bit disposed at the end of a drill string;

B) pressurizing hydraulic fluid at the ground surface and conducting the pressurized hydraulic fluid downwardly through the drill string during step A to actuate a down-the-hole hammer disposed above the drill bit for applying percussive impacts thereto;

C) retracting the drill string upwardly while rotating the drill string; and

D) pressurizing grout at the ground surface and conducting the pressurized grout downwardly through the drill string during step C and ejecting the pressurized grout laterally outwardly through a lateral opening in the drill string whereby the opening rotates with the drill string to produce a console of mixed soil and grout surrounding the hole.

2. The method according to claim 1 wherein the pressurizing of hydraulic fluid in step B and the pressurizing of grout in step D are performed in respective chambers of a multi-chamber pump disposed at the ground surface.

3. The method according to claim 1 wherein the hydraulic fluid pressurized in step B is water.

4. The method according to claim 1 further including the step of sealing upper and lower ends of the hammer during step D.

5. The method according to claim 1 wherein the grout is ejected at a location above the hammer.

6. A soil consolidation apparatus comprising:

a drill rig;

a drill string mounted to the drill rig to be rotated, lowered, and raised, thereby;

a percussive drill bit mounted at an end of the drill string;

a down-the-hole hammer mounted above the drill bit for applying percussive impacts thereto;

a source of hydraulic fluid;

a source of grout;

pressurizing apparatus for selectively pressurizing the hydraulic fluid and the grout;

the drill string including a lateral opening formed therein;

a first channel disposed in the drill string and connected to the hammer for conducting pressurized hydraulic fluid to the hammer for actuating the hammer during a drilling operation; and a second channel disposed in the drill string separate from the first channel, for conducting pressurized grout to the lateral opening for ejection therethrough during upward retraction of the drill string.

7. The apparatus according to claim 6 wherein the pressurizing apparatus comprises a multi-chamber pump for pressurizing the hydraulic fluid and the grout in respective chambers thereof.

8. The apparatus according to claim 6 wherein the source of hydraulic fluid comprises a source of water.

9. The apparatus according to claim 6 further including one-way check valves for sealing upper and lower ends of the hammer during the ejection of pressurized grout from the drill string.

10. The apparatus according to claim 6 wherein the lateral opening is disposed above the hammer.

11. The apparatus according to claim 6 wherein the second channel surrounds a section of the first channel.

12. A soil consolidation tool comprising:

a drill string;

a percussive drill bit mounted at an end of the drill string;

a hydraulically driven down-the-hole hammer mounted above the drill bit;

a first channel disposed in the drill string and connected to the hammer for conducting pressurized hydraulic fluid thereto;

a lateral grout-ejecting opening disposed in the drill string;

a second channel formed in the drill string separate from the first channel and connected to the grout-ejecting opening for conducting pressurized grout to the opening.

13. The tool according to claim 12 wherein the grout ejecting opening is disposed above the hammer.

14. The tool according to claim 12 further including one-way check valves for sealing upper and lower ends of the hammer.

15. The tool according to claim 12 wherein the second channel surrounds a section of the first channel.

* * * * *